US007013864B2

(12) United States Patent
Ganz et al.

(10) Patent No.: US 7,013,864 B2
(45) Date of Patent: Mar. 21, 2006

(54) FUEL INJECTOR

(75) Inventors: Benedikt Ganz, Elchesheim-Illing (DE); Jean-Francois Gaudry, Stuttgart (DE); Hans Hartmann, Stuttgart (DE); Rolf Klenk, Stuttgart (DE); Andreas Mlejnek, Stuttgart (DE); Klaus Robler, Stuttgart (DE); Helmut Scheffel, Holzgerlingen (DE); Dirk Strubel, Stuttgart (DE); Matthias Zahn, Mannheim (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 11/053,188

(22) Filed: Feb. 8, 2005

(65) Prior Publication Data

US 2005/0188949 A1 Sep. 1, 2005

Related U.S. Application Data

(63) Continuation-in-part of application No. PCT/EP2003/007909, filed on Jul. 19, 2003.

(30) Foreign Application Priority Data

Aug. 9, 2002 (DE) ..... 102 36 622

(51) Int. Cl.
*F02B 5/00* (2006.01)

(52) U.S. Cl. ..... 123/305; 123/299

(58) Field of Classification Search ..... 123/305, 123/299, 295, 430, 301, 276; 239/556–559
See application file for complete search history.

(56) References Cited

U.S. PATENT DOCUMENTS

| | | | | | |
|---|---|---|---|---|---|
| 2,098,031 | A | * | 11/1937 | Essl | 123/256 |
| 3,698,364 | A | * | 10/1972 | Jones | 123/205 |
| 4,919,093 | A | * | 4/1990 | Hiraki et al. | 123/299 |
| 5,170,758 | A | * | 12/1992 | Chmela | 123/276 |
| 6,622,693 | B1 | * | 9/2003 | Arndt et al. | 123/299 |
| 6,659,074 | B1 | * | 12/2003 | Lippert et al. | 123/299 |
| 6,883,491 | B1 | * | 4/2005 | Arndt et al. | 123/305 |
| 2002/0020766 | A1 | | 2/2002 | Kobayashi et al. | |

FOREIGN PATENT DOCUMENTS

| | | |
|---|---|---|
| DE | 198 04 463 | 8/1999 |
| DE | 39 43 816 | 1/2001 |
| DE | 100 32 336 | 1/2002 |
| DE | 101 22 350 | 11/2002 |
| DE | 101 24 750 | 11/2002 |
| EP | 1 283 336 | 2/2003 |
| FR | 2 807 103 | 10/2001 |

* cited by examiner

*Primary Examiner*—Mahmoud Gimie
(74) *Attorney, Agent, or Firm*—Klaus J. Bach

(57) ABSTRACT

In a fuel injector for a direct-injection internal combustion engine comprising an injection nozzle, on the circumference of which a plurality of injection orifices are arranged so as to line up with one another, to form an orifice arrangement for the formation of an essentially conical fuel cloud from the individual fuel jets of the respective injection orifices the nozzle orifice locations are displaced so as to form a recess in the jet envelope in an area where a spark plug is located into which the spark plug extends so as to safely ignite the fuel cloud without getting wetted by the fuel.

10 Claims, 4 Drawing Sheets

| | $\xi$ | $\eta$ | $\mu$ | Number of directions |
|---|---|---|---|---|
| $S_2$ | 0.57737 | 0.57737 | 0.57737 | 4 |
| $S_4$ | 0.29588 | 0.29588 | 0.90825 | 12 |
| $S_{44}$ | 0.10582<br>0.30343 | 0.10582<br>0.67377 | 0.98874<br>0.67377 | 24 |
| $S_{6a}$ | 0.19148<br>0.19148 | 0.19148<br>0.69402 | 0.96264<br>0.69402 | 24 |
| $S_{6b}$ | 0.18387<br>0.18387 | 0.18387<br>0.69505 | 0.96560<br>0.69505 | 24 |
| $S_8$ | 0.57737<br>0.14226<br>0.14226 | 0.57737<br>0.14226<br>0.57735 | 0.57737<br>0.97955<br>0.80401 | 40 |
| DCT020-1246 | 0.13146<br>0.25167 | 0.13146<br>0.68435 | 0.98257<br>0.68435 | 24 |
| DCT020-2468 | 0.24154<br>0.26524 | 0.24154<br>0.68178 | 0.93984<br>0.68178 | 24 |
| DCT111-1246810 | 0.19153<br>0.04640<br>0.57737 | 0.49896<br>0.04640<br>0.57737 | 0.84520<br>0.99784<br>0.57737 | 40 |
| DCT-111-24681012 | 0.20417<br>0.18046<br>0.57737 | 0.53562<br>0.18046<br>0.57737 | 0.81940<br>0.96688<br>0.57737 | 40 |

Fig. 3

FUEL INJECTOR

This is a Continuation-In-Part Application of International Application PCT/EP2003/007909 filed Jul. 19, 2003 and claiming the priority of German application 102 36 662.5 filed Aug. 9, 2002.

BACKGROUND OF THE INVENTION

The invention relates to a fuel injector for a direct-injection spark-ignition internal combustion engine wherein the injector is provided with a plurality of nozzle openings arranged such that the fuel discharged therefrom forms a spray cone generating a fuel cloud.

In spark-ignition combustion engines, an inflammable fuel/air mixture is to be provided in the combustion space at the point of ignition at least in the region of the spark plug. It is known to inject fuel into a combustion chamber to form a fuel cloud in the region of the spark plug during low load engine operation. The cloud is formed only in the region of the spark plug and the engine thus can be operated with lower fuel consumption. For controlled fuel injection with a view to a controlled formation of a fuel cloud in the region of the spark plug, injectors with injection nozzles having a plurality of injection orifices are known, an individual fuel jet penetrating through each injection orifice into the combustion space. DE 39 43 816 C2 discloses a multihole nozzle for the injection of fuel, in which some of the injection orifices are designed in such a way that the fuel jets generated by them are directed into an air vortex in the combustion space, said air vortex evaporating the fuel of the injection jets and transporting it to the spark plug within the shortest possible time.

A fuel injection system for spark-ignition engines with a multihole injector is known from DE 198 04 463 A1, the injection orifices being arranged, lined up with one another, on the circumference of the injection nozzle, and a jet-managed combustion method thus being implemented as a result of the formation of a mixture cloud. The injection orifices on the circumference of the injection nozzle in this case form a conical jet, the individual fuel jets of the respective injection orifices forming a closed or coherent fuel cloud of conical form. In a known fuel injector, the injection orifices of the conical jet belt may also be arranged in two rows, with the result that the density of the outer surface area of the conical jet can be improved and consequently even larger cone angles of the conical jet can be made possible.

By means of the known arrangement of the injection orifices so as to form a conical jet, a coherent mixture cloud can be formed in the combustion space. The aim is to achieve as optimal a combustion behavior of the mixture cloud as possible with a view to as low an exhaust gas emission and as low a fuel consumption of the internal combustion engine as possible. It became clear that improved results can be achieved by means of a rapid burn-up of the mixture cloud. However, with conical fuel injection, a rapid burn-up of the mixture cloud is not possible by means of the known multihole injector. Also, in the event of deposits (carbonization) in individual injection holes in the conical jet, the flame path may be impeded by too lean a mixture in the conical cloud. Even the known arrangement of the injection holes in two rows over the circumference of the injection nozzle cannot eliminate this problem, since, at most, the thickness of the fuel-rich layer in the outer surface area of the conical cloud can be increased.

It is the object of the present invention to provide a generic fuel injector in such a way that a continuous burn-up of the fuel cloud is ensured.

SUMMARY OF THE INVENTION

In a fuel injector for a direct-injection internal combustion engine comprising an injection nozzle, on the circumference of which a plurality of injection orifices are arranged so as to line up with one another, to form an orifice arrangement for the formation of an essentially conical fuel cloud from the individual fuel jets of the respective injection orifices the nozzle orifice locations are displaced so as to form a recess in the jet envelope in an area where a spark plug is located into which the spark plug extends so as to safely ignite the fuel cloud without getting wetted by the fuel.

Preferably, in the region of the surface of the injection nozzle wherein the injection orifices forming the conical jet are disposed, further injection orifices are provided through which fuel is injected into the interior of the conical mixture cloud in a controlled manner. This results, overall, in a more uniform fuel distribution in the jet cone. In this way, the formation of zones of lean mixture within the fuel cloud is enriched, and a more rapid burn-up of the mixture cloud formed from uniformly distributed fuel is obtained.

Advantageously, the surface of the injection nozzle is spherical, with the result that the individual injection orifices direct their fuel jets into different regions within the fuel cone. In an advantageous design of the invention, at least one central injection orifice is provided in the region of a longitudinal axis of the injector, the central injection orifice preferably lying on the longitudinal axis of the nozzle. Fuel is thereby injected into that central region of the conical mixture cloud which cannot be reached by the injection orifices in the conical jet, so that, overall, the uniformity of the fuel distribution in the jet cone is promoted.

Alternatively, the injection orifices can be arranged in a plurality of parallel planes of the spherical injection nozzle with respect to the longitudinal axis of the injector. Large regions of space of the injection cone are covered in different planes on the spherical surface of the injection nozzle by the individual injection orifices. The uniform mixture distribution can in this case be promoted by different cross-sectional sizes of the injection orifices of the different planes, by different injection angles of the injection orifices in individual planes or by a combination of the measures.

It is particularly advantageous if the injection orifices are distributed uniformly over the entire surface of the injection nozzle, in order thereby to achieve as optimum a distribution as possible even of the fuel jets generated by them in the space around the injection nozzle. These injection orifices may in this case be distributed on the available spherical surface of the injection nozzle in accordance with boundary value considerations, for example on the basis of the collocation method according to Cannuto.

To improve the inflammability and combustion behavior of the mixture cloud, there is provision, according to the invention, in the circumferential region of the injection nozzle which corresponds to the position of a spark plug in relation to the injector at the intended installation position of the injector, for at least one injection orifice lying in this circumferential region to be designed differently from other injection orifices in terms of position and/or orifice geometry in such a way that a fuel jet having a smaller cone angle is generated. As a result, a gap in the fuel density of the cone envelope and consequently a notch-shaped indentation is formed in the conical cloud. In this way, a rich mixture can be prepared rotationally symmetrically about the longitudinal axis of the injector or of the conical jet generated by the latter and at the same time a wetting of the spark plug with fuel can be avoided if the spark plug projects into the notch region formed in the mixture envelope. A jet-managed combustion method can thereby be implemented, without harmful deposits being formed on the spark plug due to the wetting of the spark plug with the liquid fuel. Thus, ignition misfiring is counteracted and, moreover, the stress on the spark plug due to high heat shock is reduced, so that the useful life of the spark plug is increased.

To produce the notching in the cone envelope by the fuel jet, in the corresponding circumferential position one or more of the injection orifices are arranged nearer to the injector axis differently from their virtual position in a row of injection orifices of equal axial level on the circumference of the injection nozzle. The formation of the notch may also advantageously be achieved by designing the injection orifice differing in its jet pattern for adjacent injection orifices of equal axial height on the injection nozzle with an injection angle which is advanced in the direction of the longitudinal axis of the injector. Furthermore, to form the notch in the mixture envelope, into which notch the spark plug is to project, the distance between at least two adjacent injection orifices may be increased in the corresponding circumferential region of the injection nozzle. Preferably, the injection orifices of the injection nozzle according to the invention are rounded by means of hydroerosive treatment.

Exemplary embodiments of the invention will be described below in more detail with reference to the accompanying drawings.

DESCRIPTION OF PARTICULAR EMBODIMENTS

Figure 1:
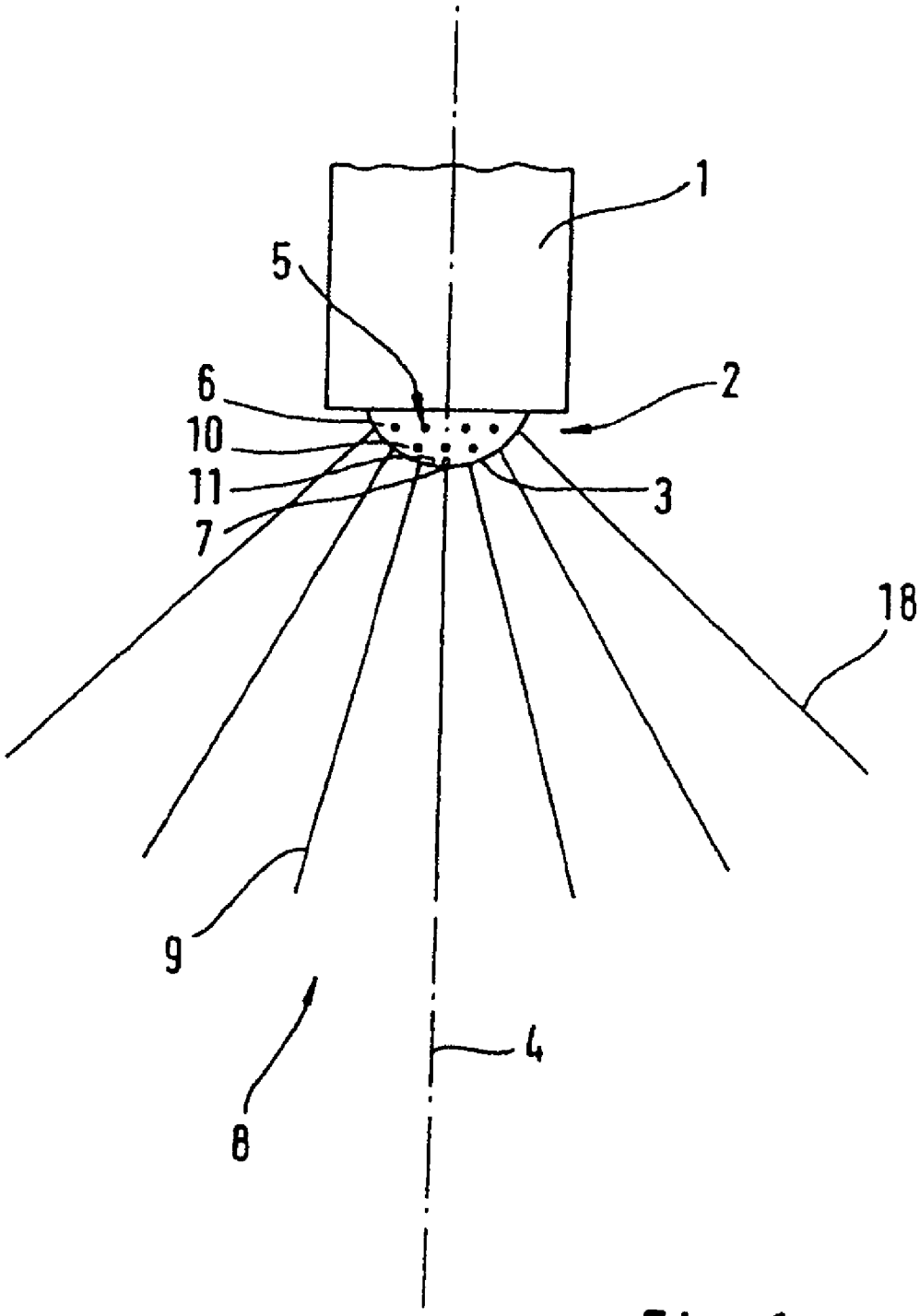
FIG. 1 is a diagrammatic illustration of a fuel injector with conical fuel injection.
Figure 2B:
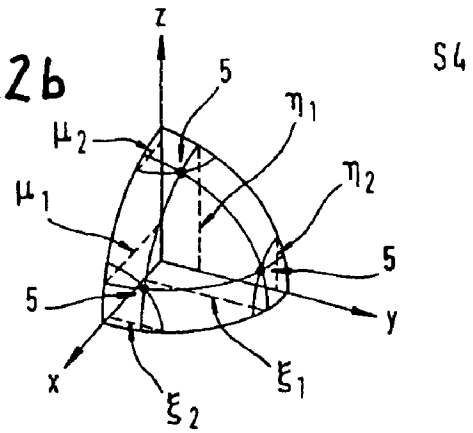
FIGS. 2*a*–2*d* show embodiments of the distribution of the injection orifices on the surface of the injection nozzle, FIG. 3 show a table of the injection directions corresponding to the arrangements of injection orifices of FIG. 2.
Figure 2D:
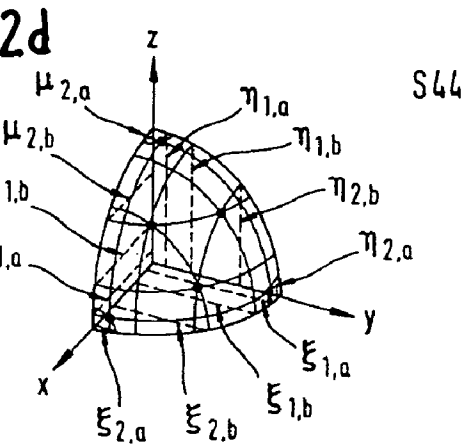
Figure 2A:
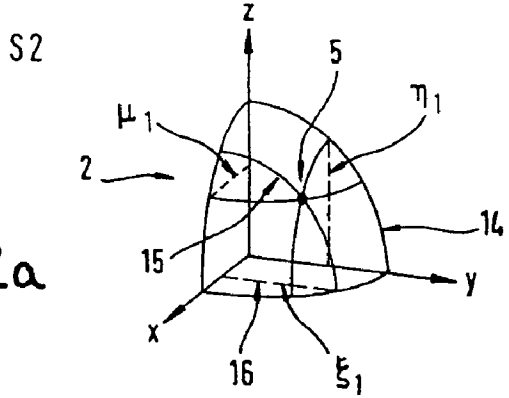
Figure 2C:
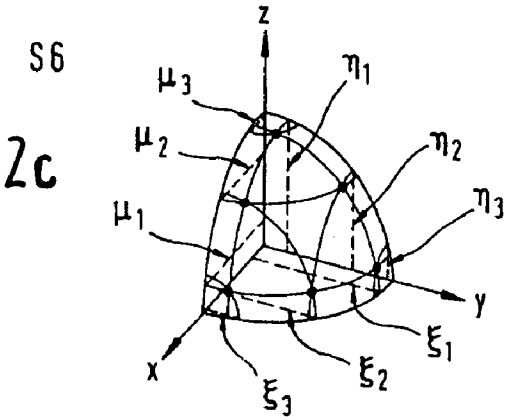

FIG. 1 shows a fuel injector 1 for a direct-injection spark-ignition internal combustion engine, said fuel injector has an injection nozzle 2 provided with a plurality of injection orifices 5. For injection, a nozzle needle, not illustrated here, is moved piezoelectrically inside the injector 1 and builds up inside the injection nozzle 2 an excess fuel pressure fuel which forces the fuel through the injection orifices 5 into the combustion space. The injection pressure may in this case amount to about 250 bar, depending on the operating point of the internal combustion engine. The surface 3 of the injection nozzle 2 is shaped spherically and, in the exemplary embodiment shown, has approximately the contour of a hemisphere. The injection orifices 5 are distributed essentially uniformly on the circumference of the spherical injection nozzle 2, the fuel jets 9 of the individual injection orifices 5 together forming a conical jet 8. The conical jet 8 is in this case generated essentially rotationally symmetrically with respect to the longitudinal axis 4 of the injector 1, with the result that a conical fuel cloud is formed in the combustion space. According to the jet-managed combustion method, by means of the fuel injected in a controlled manner a spatially oriented mixture cloud having the combustion air supplied separately to the combustion space is formed. The mixture cloud is in this case formed in a controlled manner in the region of a spark plug which projects into the combustion space and which ignites the mixture cloud owing to the formation of an ignition spark.

The injection orifices 5 are distributed uniformly on the surface 3 of the injection nozzle 2, some of the injection orifices 5, lined up with one another on the circumference of the injection nozzle 2, form a conical jet arrangement 6 and with their fuel jets 18 define the outer envelope area of the conical fuel jet 8. Inside the annular conical jet arrangement 6, there are provided further injection orifices 5, the fuel jets 9 of which are directed into the inner region of the fuel cone 8. In this way, on the one hand, a coherent cone envelope is generated by the injection orifices 5 and, also the inner region of the cone envelope 18 is filled uniformly with the fuel by the further injection orifices 5, with the result that a conical jet 8 with a uniform fuel distribution is generated. By means of the uniform fuel distribution in the conical jet 8, a mixture cloud can be formed which burns up quickly after ignition by the spark plug, since regions of space in the mixture cloud which have low inflammability because of low fuel concentrations are ruled out. Expediently, at least one injection orifice is provided in the central region in order to fill up the inner region of the fuel cone.

In the exemplary embodiment shown, particularly advantageously, a central injection orifice 7 which lies on the longitudinal axis 4 of the injector 1 is provided. With a view to as uniform a fuel distribution as possible, in the exemplary embodiment shown the injection orifices 5 are arranged in a plurality of spaced parallel planes 6, 10, 11, 7 extending normal to the longitudinal axis 4 of the injector, the foremost plane in the region of the tip of the injection nozzle 2 includes the central injection orifice 7 on the longitudinal axis 4. The injection orifices 5 are lined up on the opposite side of the hemispherical injection nozzle 2 forming the conical jet belt 6. The injection orifices 5 of the various planes may in this case have different injection angles, in which case, with regard to the injection orifices 5 in the conical jet belt 6, a stable envelope covering of the conical jet 8 can be generated, even in the event of relatively large cone angles, and, in addition, by an appropriate choice of the injection angles of other injection orifices 5, the inner region can be supplied uniformly with fuel.

Alternatively or additionally to the orientation of the fuel jets 9 of the injection orifices 5 by means of the injection angle of the respective orifices 5, a uniform fuel distribution may be achieved by means of a suitable selection of the cross-sectional sizes of the injection orifices 5 in the individual planes. Suitable jet characteristics can be achieved if the injection holes 5 are rounded by means of hydroerosive treatment. In this case, optimum results in terms of mixture formation and consequently the combustion behavior of the fuel cloud can be achieved with diameters of the injection orifices 5 of less than 0.125 mm.

In order to achieve as uniform a distribution as possible of the injection orifices 5 on the spherical surface 3 of the injection nozzle 2, the injection orifices 5 may be determined, depending on the intended number of injection holes 5, on the basis of boundary value considerations according to the collocation approach of Cannuto. In this case, a plurality of injection directions are obtained for each of the injection orifices 5 on the spherical injection nozzle 2, as a result of which the fuel cone 8 is supplied uniformly with fuel from the individual orifices 5.

FIG. 2*a*–2*d* shows the possibilities of the combination of various injection directions as a function of the number of injection orifices 5. In each of the four exemplary embodiments shown, in each case a spherical sector of the injection nozzle 2 in the form of an Euler triangle is shown, which is defined by means of a coordinate system having coordinate axes x, y and z perpendicular to one another. An injection orifice 5 thus defines in each case three small circles 15 of the spherical surface which lie in each case parallel to the planes spanned by the coordinate system. By the small circles 15 being projected onto the coordinate planes, the projection straight lines 16, which correspond in each case to an injection direction $\xi$, $\eta$ and $\mu$, are obtained. The possibilities for the jet directions in the case of a corresponding arrangement of the injection orifices 5 on the spherical triangles are collated in the table according to FIG. 3. With one injection orifice 5 being arranged on the spherical triangle, according to illustration S2, four possible jet directions are thus obtained. With three injection orifices being arranged, according to the illustration S4, twelve possible jet orientations are available. Correspondingly, with an arrangement of six injection orifices 5, as shown in S6, in each case three injection orifices 5 lying on a common small circle of the sphere, even 24 jet directions are afforded. The arrangement S44 constitutes an alternative possibility of the arrangement of six injection orifices on the spherical segment, in which case 24 jet directions are likewise obtained in the case of a number of injection orifices, but, as listed in FIG. 3, other jet directions are available. Further possibilities for arranging the injection holes on the spherical segment and the combination of the arrangements are proposed in FIG. 3.

Figure 4:
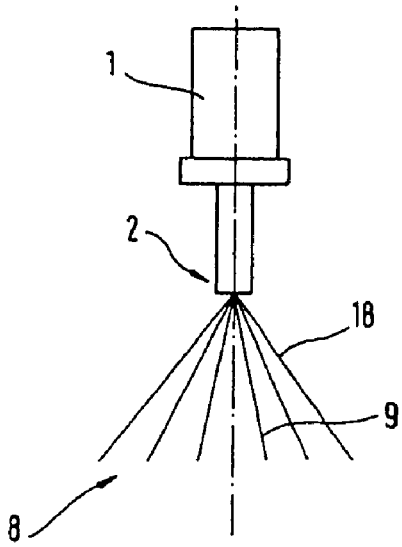
FIG. 4 shows a diagrammatically of an injector.
Figure 5:
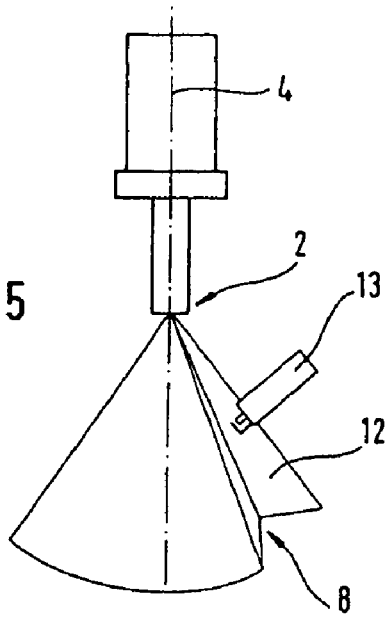
FIG. 5 shows diagrammatically an injector with fuel injection protecting the spark plug.

As shown in FIG. 4, the injection nozzle 2 of the injector 1 generates an essentially rotationally symmetrical conical jet 8 which consists of envelope jets 18 and of fuel jets inside the conical jet 8 and which is therefore characterized by uniform fuel concentration over the entire region of the cone. As shown in FIG. 5, to protect a spark plug 13 in a circumferential region of the injection nozzle 2, which corresponds to the relative position of the spark plug 13 at the intended installation position of the injector 1, at least one injection orifice lying in this circumferential region is designed differently from the other injection orifices of equal axial height on the injection nozzle 2 in such a way that, in this circumferential region, a notch 12 is generated in the conical jet which is otherwise formed rotationally symmetrically with respect to the longitudinal axis 4. The notch in the outer surface area of the conical jet is achieved in that, in this circumferential region of the conical jet, fuel jets of individual injection orifices having a smaller angle with respect to the longitudinal axis 4 of the injector 1 are generated than those of comparable injection orifices of equal height on the injection nozzle 2. The electrodes of the spark plug 13 which project into the notch 12 thus formed in the conical jet 8 are not wetted with fuel on account of the deformation of the fuel jet, so that the formation of deposits and carbonization under thermal stress is counteracted.

Figure 6A:
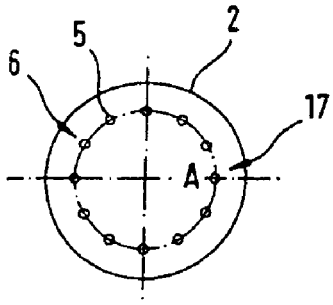
FIGS. 6*a* and 6*b* show an arrangement of the injection holes for the protection of the spark plug.
Figure 6B:
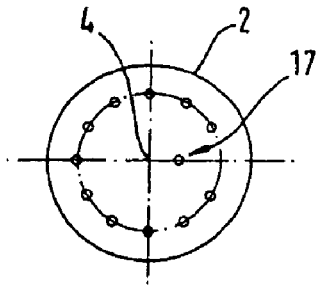

To form the notch 12, in the respective circumferential region a configuration differing from the remaining circumferential region is carried out in the conical jet belt 6 in the ring of injection orifices 5. As shown in FIGS. 6*a* and 6*b*, in the conical jet ring 6, an injection orifice 17 is arranged, in the circumferential region provided for formation of the notch, so as to be displaced in the direction of the injector axis 4, differently from the virtual position A illustrated in FIG. 6*a*, see FIG. 6*b*. The jet orientation of the differing injection orifice 17 of the fuel jet having a smaller angle with respect to the longitudinal axis 4 of the injector for the purpose of forming the notch 12 in the cone envelope may be selected alternatively or additionally by means of an advanced injection angle of the injection orifice 17 lying in the respective circumferential region of the injection orifice row. As a further alternative, an increase in the distance between the adjacent injection orifices in the relevant circumferential region of the orifices of the conical jet belt 6 is available for the purpose of forming the notch.

What is claimed is:

1. A fuel injector for a direct-injection internal combustion engine, with an injection nozzle (2), having a partially spherical surface (3) and, on the circumference thereof, a plurality of injection orifices (5) lined up with one another belt-like to provide a conical jet (8) for the formation of an essentially conical fuel cloud from the individual fuel jets (9) of the respective injection orifices (5), additional injection orifices (5) arranged within the region of the spherical surface (3) of the injection nozzle (2) which is delimited by the conical jet orifice (6), and, in a circumferential region of the injection nozzle (2) which corresponds to the position of a spark plug (13) at least one injection orifice (17) which, in this circumferential region, is arranged differently from other injection orifices (5) in such a way that a fuel jet (9) emitted therefrom is oriented at a smaller angle with respect to the longitudinal axis (4) of the injector (1), so as to provide for a recess (12) in the circumference of the conical fuel jet generated by the infection nozzle (2).

2. The injector as claimed in claim 1, wherein the at least one differing injection orifice (17) is arranged nearer to the injector axis (4) than a virtual position (A) in a row of injection orifices (5) of equal axial height on the injection nozzle (2).

3. The injector as claimed in claim 1, wherein the at least one differing injection orifice (17) is displaced ed forwardly on the spherical surface (3) of the injection nozzle (3) so as to provide for a smaller injection angle with the longitudinal axis (4) of the injector.

4. The injector as claimed in claim 1, wherein, in the circumferential region of the injection nozzle (2) which corresponds to the relative position of a spark plug (13) with respect to the injector at the intended installation position of the injector (1), the distance between at least two adjacent injection orifices (5) is increased.

5. The injector as claimed in claim 1, wherein the surface of the injection nozzle (2) is spherical.

6. The injector as claimed in claim 1, wherein at least one central injection orifice (7) is provided in the region of a longitudinal axis (4) of the injector (1), and preferably one injection orifice (7) extends along the longitudinal axis (4).

7. The injector as claimed in claim 1, wherein injection orifices (5) are provided in a plurality of parallel spaced planes (6, 7, 10, 11) extending normal to the longitudinal axis (4).

8. The injector as claimed in claim 7, wherein the injection orifices (5) of different planes (6, 7, 10, 11) have different injection angles.

9. The injector as claimed in claim 7, wherein the injection orifices (5) of different planes (6, 7, 10, 11) have different flow cross-sections.

10. The injector as claimed in claim 1, wherein the injection holes (5) are rounded by means of hydroerosive treatment.

* * * * *